United States Patent [19]

Doi

[11] Patent Number: 4,886,774

[45] Date of Patent: Dec. 12, 1989

[54] ULTRAVIOLET PROTECTIVE OVERCOAT FOR APPLICATION TO HEAT SENSITIVE RECORD MATERIALS

[76] Inventor: Alfred Doi, 19471 Sierra Chula Rd., Irvine, Calif. 92715

[21] Appl. No.: 230,073

[22] Filed: Aug. 9, 1988

[51] Int. Cl.[4] ..... B41M 5/18

[52] U.S. Cl. ..... 503/226; 427/150; 427/151; 427/152; 428/211; 428/913; 503/200

[58] Field of Search ..... 427/150–152; 428/211, 913; 503/200, 226

[56] References Cited

U.S. PATENT DOCUMENTS 4,484,204 11/1984 Yamamoto et al. ..... 346/200
4,663,642 5/1987 Kameda et al. ..... 503/221

FOREIGN PATENT DOCUMENTS 3549 1/1979 Japan ..... 503/221
284483 12/1986 Japan ..... 503/221

OTHER PUBLICATIONS

Dr. G. Pasternack, Radiation Curable Coatings–A Technology for the 1980's, pp. 1–18.
Roland Winter, Stabilizers, Ultraviolet, Modern Plastics Encyclopedia 1988, pp. 177–178.
Modern Plastics Encyclopedia 1988, pp. 651–652.
Irgacure 184, Photoinitiator for Ultraviolet Curing of Coatings, Ciba-Geigy Brochure, Ciba-Geigy Corp, 1986.
Tinuvin 1130, Liquid Ultraviolet Light Absorber for Coatings, Ciba-Geigy Brochure, Ciba-Geigy Corp. 1987.
DeSolite Data 950×333, Flier from DeSoto, Inc.
Tinuvin 292, Hindered Amine Light Stabilizer for Coatings, Ciba-Geigy Brochure, Ciba-Geigy Corp., 1981.

*Primary Examiner*—Bruce H. Hess
*Assistant Examiner*—P. R. Schwartz
*Attorney, Agent, or Firm*—Stetina and Brunda

[57] ABSTRACT

Disclosed is an ultraviolet curable/ultraviolet protective overcoating for application to heat and/or pressure sensitive record materials known to undergo degratory effects when exposed to ultraviolet radiation within a known "photodegratory" wavelength range. The overcoatings of the invention generally contain a first additive which promotes curing of the overcoating by UV radiation outside of the "photodegratory" range and a second additive which remains present within the cured overcoat and serves to absorb or otherwise prevent transmission of UV radiation within the "photodegratory" range. Additionally, the overcoatings of the invention may contain a third additive capable of acting as a free radical scavenger within the cured overcoating, thereby preventing or minimizing certain degratory effects of free radicals within or adjacent to the cured overcoating.

21 Claims, No Drawings

ULTRAVIOLET PROTECTIVE OVERCOAT FOR APPLICATION TO HEAT SENSITIVE RECORD MATERIALS

BACKGROUND OF THE INVENTION

The invention relates generally to an improved overcoating material for protecting various heat sensitive record materials.

Specifically, the invention relates to an improved overcoating composition which is capable of protecting an underlying heat sensitive record material from the deleterious effects of (a) ultraviolet radiation, (b) physical abrasion and (c) certain chemicals while at the same time preventing excessive abrasion and wear of the thermal printing head used to form the desired printed images on the underlying record material.

As will be explained herein, the invention is particularly applicable to commercial labeling processes wherein machine readable indicia (e.g. bar codes) are thermally printed upon a heat sensitive paper. Accordingly, the invention is described herein with reference to such applications. It must be appreciated, however, that the invention has broader applicability and may find utility in connection with virtually any thermal or pressure sensitive printing process. Examples of other thermal label/tag printing applications wherein the present invention may be useful include, but are not limited to, laboratory strip chart recorders, electrocardiography, data processing, facsimile transmissions, pressure sensitive business forms, etc.

Many types of thermal printing papers or "heat sensitive record materials" are known in the prior art. Typically, such record materials comprise (a) a base sheet of paper or other "base material" and (b) a filmlike heat sensitive "record layer" formed thereupon. The "record layer" generally contains dispersions of reactive chemicals which are capable of reacting with one another to form a desired colored or darkened image in response to the application of heat and or pressure. Thus, when a thermal printing head applies heat to the heat sensitive record layer, the desired printed image will be formed therein.

The particular types or classes of reactive chemicals contained in the heat sensitive record layer generally dictate the type and density of color image formed therewithin. With respect to commercial labeling applications, two general types of color forming chemical systems have been employed.

First, many heat sensitive record materials used in commercial labeling applications have record layers which contain at least two reactive chemicals—a "color former" and a "dye precursor". The color former and the dye precursor are capable of reacting with one another to form a desired colored image. The color former and the dye precursor materials may be separately microencapsulated or otherwise separately contained so as to prevent casual mixing with one another with resultant premature reaction. When heat is applied, however, the separately contained dye precursor cand color former will melt or otherwise flow together so as to immediately undergo the desired color forming reaction.

Many specific types of dye precursors and color formers have been employed in the heat sensitive record materials of the prior art. In most applications, it is preferable that the color former(s) and dye precursor(s) be inherently colorless, pale or white in color prior to undergoing their color forming reaction so that the record material will be appropriately light in color. Accordingly, a group of light colored alkaline dyes known as "leuco" dyes are frequently employed as dye precursors.

A comprehensive listing of prior art dye precursors is set forth in the disclosure of U.S. Pat. No. 4,484,204 entitled "Heat Sensitive Record Material" at column 3, line 21-column 4, line 4 and such listing is expressly incorporated herein by reference.

Likewise, many types of color formers have been used in conjunction with the various dye precursors. Color formers known in the art include various phenolic compounds, inorganic acids, organic acids and other materials capable of undergoing free radical reactions with one or more of the above-described dye precursors.

A list of exemplary color formers is set forth in the above cited U.S. Pat. No. 4,484,204, at column 4, lines 5–36, and is also expressly incorporated herein by reference.

In addition to the dye precursor/color former chemical systems employed in some heat sensitive record materials, others have employed metallic salt/color former chemical systems. The advent of these metalic salt/color former systems came about due to the fact that many of the previously used dye-based systems were not suitable for machine reading using near infrared scanning equipment. Thus, the metallic salt/color former systems have the advantage of being readable by commercially available infrared scanners.

Metallic salt coatings, while exhibiting enhanced readability by infrared means, tend to be more expensive than dye-based systems. Also, the metalic salt based coatings as well as the leuco dye based systems, are known to liberate $Na+$ and/or $Cl-$ ions which have degratory effects on the thermal printing heads. Thus, it is desirable to provide a smooth overcoating which may be applied over top of such metallic salt containing record layers so as to prevent excessive abrasion, wearing or degradation of the thermal head.

Regardless of whether dye-based or metallic salt chemical systems are used to form the image within the heat sensitive record layer, all of the heat sensitive record materials known to date have exhibited certain drawbacks. One major drawback associated with such materials is that they are not suitable for long term archival applications. The non-archivability of these materials is generally owed to one or more of the following shortcomings:

1. Poor resistance to physical abrasion;
2. Poor resistance to chemical and/or substances;
3. Poor resistance to ultraviolet radiation.

Additionally, as noted above, certain heat sensitive record materials—especially those employing metalic salt based chemical systems and/or phosphorescent materials—are known to cause abrasion and damage to the thermal printing head.

The poor resistance to physical abrasion exhibited by the prior art heat sensitive record materials becomes a problem when direct pressure or friction is applied to the record material. Such direct pressure or friction will cause darkened areas or scuff marks to form on the record layer. Such darkened areas or scuff marks may obscure any printed matter contained thereon.

The poor resistance to chemicals exhibited by the prior art heat sensitive record materials often presents problems when certain plasticizers, organic solvents, detergents, oils, amines, esters and the like come in contact with the record material. Plasticizers, organic solvents and some detergents are known to cause darkening of the record layers while certain amines and esters are known to cause quenching, fading or lightening of any printed images contained thereon. The above mentioned effects of certain detergents on heat sensitive record materials is particularly problematic in commercial shelf labeling applications wherein thermally printed labels are applied to high use areas such as the exposed edges of grocery store shelves. In such applications, the labels (and the neighboring shelftop) may be frequently exposed to washing solutions which contain detergents and other chemical materials. Thus, it is desirable that any heat sensitive record materials employed in such applications be protected from the deleterious effects of such detergents or cleaning solutions.

The poor resistance to ultraviolet radiation is generally manifested as a "photodegradation" of printed images previously formed on the thermally sensitive record material. Specifically, the reactive chemicals of the record layer generally form their printed images by way of generally weak bond. When UV radiation is applied, such gives rise to an actinic reaction whereby the bond energy of the printed image is overcome so as to result in degradation of fading of the image. Photooxidative type degradation centers initially on the actinic reaction of the ultraviolet energy on the photoexcited chromophores which give rise to the colored image. A continuous chain reaction may thereby result, causing breaking of bonds, cross linking, chain branching and/or free radical production. As a result, the colored images previously formed on the record material become faded or completely degraded.

Various attempts have been made to overcome the above-described drawbacks associated with heat sensitive record materials. One possible means of overcoming such drawbacks is through the application of a protective coating over the thermally sensitive record layer. However, the conventional application of solvent carried polymer coatings to such heat sensitive record materials has been found to cause severe darkening when applied to the standard record materials. Likewise, thermally cured coatings are not useable because the heat required to bring about the desired curing of the coating also causes undesired darkening of the record layer. For these reasons it is generally accepted that coatings intended for application to heat sensitive record materials should be (a) curable by nonthermal means and (b) free of volatile organic solvents.

In view of these limitations, it has previously been proposed to utilize certain radiation curable coatings as protective overcoats on various heat sensitive record materials. Such radiation curable coatings offer the advantage of being curable in the absence of heat and are generally devoid of volatile organic solvents or other chemicals which can cause darkening of the record materials.

"Radiation curable" coatings presently fall into two basic categories—those which are curable by ultraviolet radiation and those which are curable by electron beam radiation. U.S. Pat. No. 4,484,204 (Yamamoto, et al.) describes the application electron beam curable coatings to heat sensitive record materials for the purpose of improving the chemical and/or abrasion resistance thereof. While the application of these electron beam curable coatings may indeed improve the chemical and/or abrasion resistance of the underlying record materials, such coatings will do little to resist the effects of ultraviolet radiation as no reflective or UV absorbing materials other than pigments are disclosed. While some pigments may, due to their opacity, inhibit the transmission of ultraviolet radiation they have the attendant effect of adding color to the overcoat and may, when present in high concentrations, obscure any underlying printed images. Thus, because these prior art electron beam curable coatings fail to provide adequate ultraviolet resistance, they do not render the record material suitable for archival applications. While U.S. Pat. No. 4,484,204 does also describe the application of one ultraviolet curable coating to a heat sensitive record material (comparison Example 6, Col. 14, lines 14–22), the ultraviolet curable coating described therein is purportedly inferior in many respects to the various electron beam cured coatings to which it was compared (Table I).

Thus, there remains a need for improved radiation curable coatings which are capable of providing strength, chemical resistance, abrasion resistance dimensional stability and enhanced thermal head life while also protecting the underlying record material from the deleterious effects of ultraviolet radiation within a specific or known wavelength range.

BRIEF DESCRIPTION OF THE INVENTION

The present invention overcomes the above-described shortcomings and limitations of the prior art by providing an improved, ultraviolet curable, generally transparent protective overcoating formed upon a heat sensitive record material. The improved overcoating of the present invention contains at least one "photoinitiator" which is curable by ultraviolet radiation within a first wavelength range. After the curing of the overcoating is complete, an "ultraviolet absorber" remains present within the coating and subsequently acts to prevent the transmission therethrough of ultraviolet radiation within a second wavelength range. Such second wavelength range generally includes those wavelengths which are known to cause damage or photodegradation of printed images formed on the underlying heat sensitive record material. In addition, the overcoating of the present invention may also contain a "light stabilizer" capable of scavenging or otherwise reacting with free radicals. The inclusion of such "light stabilizer" within the overcoating composition is specifically effective, when applied to a heat sensitive record material, in that it will stabilize the generally weak bonds formed between the leuco dye/colorformer and/or the metalic salt/colorformer systems and will prevent free radicals from degrading or quenching the printed images formed on the record material.

More specifically, in accordance with the invention there is provided a protective overcoating composition comprising (a) an ultraviolet curable liquid mixture containing reactive components capable of polymerizing to form a generally solid coating material; (b) a photoinitiator substance capable of initiating polymerization of the reactive components in response to ultraviolet radiation within a first wavelength; and (c) an ultraviolet absorbing additive which will remain present within the cured coating at a level sufficient to absorb and prevent transmission of ultraviolet radiation within a second wavelength range. By such formulation, the overcoatings of the present invention are uniquely capable of protecting the underlying record material from the effects of ultraviolet radiation within a specific wavelength range. The wavelength range at which the UV absorber will function should encompass those wavelengths which are known to cause particular degratory effects on the underlying record material. For example, certain materials employing the leuco dye/-color former systems are known to be particularly sensitive to the photodegradative effects of ultraviolet radiation within the wavelength of 340–390 nm. Accordingly, a preferred overcoating for such record materials will contain a UV absorber capable of specifically absorbing UV radiation within such wavelenth range. Furthermore, in order to ensure that the UV absorber remains unconsumed and present within the cured overcoat, such UV absorber should be substantially unaffected by UV radiation outside such target wavelenth range. Such is especially important because, in the present invention, the photoinitiation of the coating polymerization is specifically intended to occur at a wavelength outside this target wavelength range. It is thus desirable that the UV exposure occurring during the photoinitiation step have little or no effect on the UV absorber which is intended to remain in the overcoat after curing is complete so as to protect the underlying record material from UV radiation within the target wavelength range. Photoinitiators capable of initiating polymerization at relatively low ultraviolet wavelengths (<330 nm) include those of the substituted acetophenone class. In particular 1-hydroxycyclohexyl phenyl ketone, which is known to have UV absorption maxima at 203 nm, 242 nm and 326 nm, has been found to be particularly useful as a photoinitiator in the present invention.

UV absorbers capable of absorbing radiation within the 340–390 nm range generally include those compounds of the hydroxyphenyl benzotriazole class. Known UV absorbers within such class include, but are not limited to:

2(2'-Hydroxy-5'-methaylphenyl)benzotriazole
2-3(3'5'-Di-t-butyl-2'-hydroxyphenyl)-5-chlorobenzotriazole
2-(3'-1-Butly-2'-hydroxy-5'-methanlyphenyl)-5-chlorobenzotriazole
2(2'-Hydroxy-3',6'-di-t-butylphenyl)benzotriazole
2(2'-Hydroxy-3',5'-di-t-amylphenyl)benzotriazole
2(2'-Hydroxy-5-t-octylphenyl)benzotriazole
Poly(oxy-1,2-ethanediyl), α-(3-(3-(2H-benzotriazol-2-yl)-5-(1,1-dimethylethyl)-4-hydroxyphenyl)-1-oxopropyl)-ω-hydroxy
Poly(oxy-1,2-ethanediyl), α-(3-(3-(2H-benzotriazole-2-yl)-5-(1,1-dimethylethyl)-4-hydroxyphenyl)-1-oxopropyl-ω-(3-(3-2H-benzotriazol-2-yl)-5-(1,1-dimethylethyl)-4-hydroxyphenyl)-1-oxopropoxy.

Additionally, the above-described overcoat compositions may contain the additional element of (d) one or more "light stabilizers" known to exhibit light stabilizing synergy with certain UV absorbers. Beyond such light stabilizing synergy, however, such compounds are known to exhibit specific antioxidative and free radical trapping or scavenging effects. These properties of the "light stabilizers" are unique and particularly advantageous when applied to heat sensitive record materials because certain colored images formed on the thermally sensitive materials are known to undergo quenching or degradation when acted upon by certain free radicals. The ability of these "light stabilizers" to trap or scavenge free radicals thus serves to prevent certain degratory effects of free radicals within the overcoat and/or the underlying record layer where they could fade or degrade the colored image.

One group of compounds known to be effective as free radical scavenging "light stabilizers" are the sterically hindered amines. Most of the commercially available light stabilizers of the hindred anime class are derivatives of 2,2,5,5-tetramethyl piperdine. Specific examples of hindered amine light stabilizers useable in the present invention include, but are not limited to Bis(1,2,2,6,6-pentamethyl-4-piperidinyl sebacate.

Such "light stabilizers" will also prevent certain degratory effects of ultraviolet radiation on the overcoating itself. This added effect may be important in instances where the polymeric material of the overcoating (e.g. polyolefin) contains impurities or contaminants such as ketones, hydroperoxides and certain catalyst residues which may act as chromophores, thereby leading to eventual light induced degradation and/or discolorization of the polymeric coating material. It should be noted, however, that acrylic materials are generally known to be inherently ultraviolet resistant and, in many preferred applications of the invention it will be described to use acrylic based resin systems thereby avoiding any problem of ultraviolet induced degradation of discolorization of the overcoating itself.

Further in accordance with the invention, the ultraviolet protective overcoatings may be applied to one or more surfaces of the heat sensitive record material at thicknesses sufficient to ensure the desired protection from physical abrasion, chemical damage and ultraviolet radiation while, at the same time, allowing sufficient heat transmission and flexibility as not to deter or prevent the routine use and formation of thermally printed images on the underlying record layer.

Still further in accordance with the invention, the ultraviolet resistant overcoatings of the invention may be applied in combination with other types of protective films so as to form various laminate or multi-layered composite structures. For example, a layer of polyester film may be incorporated between the overcoat and the heat sensitive record layer for the purpose of providing further chemical resistance or preventing liquid permeation.

DETAILED DESCRIPTION AND EXAMPLES OF PREFERRED EMBODIMENT

The preferred overcoating compositions of the present invention are not only resisant to the photodegradative effects of ultraviolet radiation but also provide excellent protection from physical abrasion and various degratory substances such as cleaners and detergents used to clean shelf labels, product labels, shipping labels and other applications where direct thermal printing has been or may be employed.

In addition to protecting the record material from the effects of ultraviolet radiation, physical abrasion and certain chemicals, the preferred overcoating compositions of the present invention further serve to prevent unnecessary abrasion or wear of the thermal printing heads, thereby prolonging the life of such thermal heads. This effect is particularly important in applications where the underlying record material contains photoreactive chemicals of the metalic salt/color former type and/or certain phosphorescent materials which are known to be extremely abrasive to the thermal heads. One known mechanism by which abrasion and/or other damage to the thermal heads occurs is due to the release of sodium and chloride ions as a product of the chemical reaction occuring in certain leuco dye/-color former and metalic salt/color former chemical systems. The improved overcoating compositions of the present invention are capable of preventing such sodium and/or chloride ions from coming in contact with the thermal head, thereby preventing such sodium and chloride ions from injuring the thermal head.

Cosmetically, the preferred overcoating compositions of the present invention, when applied to thermally sensitive record materials, form a high luster coating which is particularly smooth and enhances the appearance of the thermally sensitive record material.

The application of the preferred overcoatings of the present invention also improves the dimensional stability of the thermally sensitive record material because the overcoating material itself forms an independent, dimensionally stable sheet and thereby adds to the stability of the substrate to which it is applied.

In certain bar code imaging and ORC legend readings by electronic scanners, the application of the overcoating composition of the present invention has improved the accuracy, dependability and permanence of such images or readings, especially in cases where multiple scanning applications are employed.

Additionally, in applications where it is desired to form printed indicia on the heat sensitive record material by standard techniques such as flexography, offset printing or other methods, the ultraviolet curable overcoating compositions of the present invention may be rapidly applied without permitting the printed ink to dry. Thereafter, the coating may be rapidly ultraviolet cured and will thereby form a barrier to prevent smudging of the undried ink or sticking of the printed material to an adjacent sheet or other material. Such application is known in the art as "wet trapping" and is yet another area in which advantages of the overcoatings of the present invention may be realized.

Specific aspects of the presently preferred embodiment may be appreciated from the following examples. These examples are provided for the purpose of illustrating these embodiments only and are not intneded to limit the scope of the invention in any way.

EXAMPLE 1

Record Material

In this example a resinous overcoating is applied to an underlying heat sensitive record material suitable for use as product tags and known in the art as "tag stock". The record material employed in this example is of relatively rigid "card" like consistency and strength. Specifically, the record material employed in this example comprises a paper base sheet having a thermally sensitive chemical dispersion or photo "record layer" formed on the upper surface thereof. The record layer contains (a) a fluoran type lueco dye precursor and (b) a phenolic color former.

The thermally sensitive record material employed in this example is manufactured by the Kanzaki Paper Mfg. Co. Ltd., Tokyo, Japan and is provided commercially under the product designation KPT-86N. The thickness of this record material prior to overcoating is approximately 156 microns.

Under controlled testing conditions it has been determined that thermally printed images on the record material employed in this example will undergo severe and rapid fading and/or degradation in response to ultraviolet radiation within the 340–380 nm wavelength range. Thus, in accordance with the present invention, it is desirable that the overcoat be initially cured by ultraviolet radiation outside the 340–380 nm wavelength range. Also, it is desirable that the overcoat, after curing, will substantially protect the underlying record material from the effects of ultraviolet radiation within the 340–380 nm range.

Overcoat Composition

The overcoat employed in this example comprises the following:

| COMPONENT | | PERCENT BY WEIGHT |
|---|---|---|
| A. | Liquid resinous coating mixture containing: acrylated aromatic urethane oligomer (unsaturated oligomer); tetrahydrofurfural methacrylate (methacrylate monomer) trimethylopropane triacrylate (crosslinking monomer) | 94.5 |
| (Liquid resinous mixture available commercially as Desolite (trademark) 950 × 333, manufactured by Desoto, Inc., Des Plaines, Il.) | | |
| B. | Photoinitiator 1-hydroxycyclohexyl phenyl ketone | 1.5 |
| (Photoinitiator available commercially as Irgacure 184, (trademark), manufactured by Ciba-Geigy Corp., Additives Dept., Hawthorne, NY) | | |
| C | Ultraviolet Absorber A substituted hyroxyphenyl benzotirazole with two active U.V. absorbing components in polyethylene glycol as follows: | 2.0 |
| | Poly (oxy-1,2-ethanediyl),α-(3-(3-(2H-benzotriazol-2-yl)-5-(1,1-dimethylethyl)-4-hydroxyphenyl)-1-oxopropyl)-ω-hydroxy; and | 52% |
| | Poly (oxy-1,2-ethanediyl),α-(3-(3-2H-benzotriazole-2-yl)-5-(1,1-dimethyl)-4-hydroxyphenyl)-1-oxopropyl-ω-(3-(3-(2H-benzotriazole-2-yl) 5-(1,1-dimethylethyl)-4-hydroxyphenyl)-1-oxopropoxy). | 35% |
| | Polyetheylene glycol | 13% |
| (UV absorber available commercially as Tinuvin (trademark) 1130; manufactured by Ciba-Geigy Corp., Additives Dept., Hawthorne NY) | | |
| D. | Light stabilizer/Free radical scavenger Bis(1,2,2,6,6-pentamethyl-4-piperidinyl) sebacate | 2.0 |
| (Light stabilizer/free radical scavenger commercially available as Tinuvin 292 (trademark), manufactured by Ciba-Geigy Corp., Additives Dept., Hawthorne, NY) | | |

Application and Curing of Overcoat

In this example a layer of the liquid overcoating composition is applied over top of the record layer of the heat sensitive record material at a thickness of approximately 75 microns.

After the liquid coating composition has been applied, it is exposed to ultraviolet radiation at wavelengths less than 327 nanometers so as to initiate polymerization and to bring about curing of the coating.

Specifically, in this example, the ultraviolet curing is achieved by passing the coated record material, at a rate of approximately 100 feet/min., under two medium pressure mercury arc lamps operated at medium pressure so as to emit non-photodegradative ultraviolet radiation in the 290–330 nm range.

Accordingly, after the ultraviolet curing has been completed, the heat sensitive record material of this example will comprise a glossy surfaced overcoated tag stock material bearing an overcoating of approximately 75 microns. The cured coating contains sufficient ultraviolet absorber to substantially protect the underlying heat sensitive record material from the effects of known photodegradative ultraviolet radiation within the 340–380 nm range as well as hindered amine light stabilizer to synergistically enhance the effects of the UV absorber and to specifically protect the printed images from degradation by free radicals.

EXAMPLE 2

Record Material

The record material to which the overcoating is applied in this example comprises a relatively pliable, adhesive backed, record material usable as press-on product labels of the type often applied to custom wrapped cuts of meat or seafood in grocery store/-butcher/seafood departments. The record material employed in this example contains the same fluoran dye precursor/phenolic color former combination as the thicker "tag stock" described in Example 1. However, the material employed in this example is thinner and more pliable than the material described in Example 1. The thinner heat sensitive record material of this example is representative of that which is known in the art as "label stock". The heat sensitive record material in this example is manufactured and distributed by the Kanzaki Paper Mfg. Co., Ltd., Tokyo, Japan and is provided commercially under the product designation KPT86NC50W.

The thickness of this heat sensitive record material prior to overcoating is 86 microns.

Overcoat Composition

The overcoating applied in this example is the same as that applied in Example 1. However, the thickness of the overcoating applied in this example is less than that of Example 1, as described below, so as not to interfer with the pliability of the label stock.

Application and Curing of Overcoat

In this example the resinous overcoating is applied and cured in the manner described in Example 1 except that the thickness of the coating will be approximately 25 microns as opposed to the approximate coating thickness of 75 microns employed with the more rigid tag stock of Example 1.

In both of the above examples, ultraviolet curable coatings are applied to commercially available heat sensitive record materials. In accordance with the invention, the photoinitiator, UV absorber and light stabilizer additives contained in the overcoat composition were specifically selected to correspond to the particular ultraviolet wavelength range at which the printed images on the underlying record material are particularly susceptible to the effects of ultraviolet radiation.

Although the invention has been described herein with particular reference to certain exemplary embodiments it should be appreciated that the invention has much broader applicability and may be subject to various modifications, alterations and other applications without departing from the spirit and scope of the invention. For example, certain business forms and similar applications presently employ "carbonless" paper, such paper basically employs the same chemistry as described above with respect to the thermally sensitive record materials, except that the force of the writing instrument rather than heat, causes the leuco dye and color former to combine, thereby forming the desired image. The leuco dye/color former bond therein is generally weak and subject to the same UV and chemical degradation as are the thermally formed images described above with respect to the heat sensitive record materials. Accordingly, the overcoating compositions of the present invention may be applied to such pressure sensitive or "carbonless" papers for the same purposes and with the same degree of success as in the heat sensitive record materials. It is thus intended to include all such reasonable modifications, alterations and applications within the scope of the following claims.

What is claimed is:

1. An improved heat sensitive record material comprising:

a paperlike base sheet;

a thermally sensitive record layer formed upon at least one surface of said base sheet, said record layer being operative to form a visually discernable colored image in response to heat and wherein said colored image is subject to degradation as a result of exposure to ultraviolet radiation within a known photodegradative wavelength range; and an ultraviolet cured/ultraviolet protective overcoat disposed over said thermally sensitive record material, said protective overcoat having been cured ultraviolet radiation at a wavelength outside of said known photodegradative wavelength range, and said cured overcoat containing at least one additive capable of preventing transmission therethrough of ultraviolet radiation within said known photodegradative wavelength range.

2. The improved heat sensitive record material of claim 1 wherein said known photodegradative wavelength range is 340–390 nm and wherein said overcoat has been cured by exposure to ultraviolet radiation at a wavelength below 330 nm.

3. The improved heat sensitive record material of claim 1 wherein said cured overcoat further contains at least one light stabilizer capable of scavenging free radicals upon exposure to ultraviolet radiation within said known photodegradative wavelength range.

4. The heat sensitive record material of claim 1 wherein the protective overcoat comprises:

a base material containing components capable of undergoing polymerization to form a generally solid overcoat;

a photoinitiator capable of initiating polymerization of said coating components upon exposure to ultraviolet radiation within a first wavelength range; which is outside of said known photodegradative wavelength range; and an ultraviolet absorber capable of absorbing ultraviolet radiation within a second wavelength range, thereby preventing ultraviolet radiation within said second wavelength range from passing through said overcoat and into the underlying heat sensitive record material, said second wavelength range being within said known photodegradative wavelength range.

5. The heat sensitive record material of claim 4 wherein said protective overcoat further comprises an antioxidant light stabilizer capable of scavenging free radicals within the overcoat, so as to prevent said free radicals from affecting printed images formed on the underlying heat sensitive record material.

6. The heat sensitive record material of claim 4 wherein the base material comprises materials selected from the group consisting of:

oligomeric reactive materials;

diluent monomers;

crosslinking monomers; and combinations thereof.

7. The heat sensitive record material of claim 4 wherein said photoinitiator comprises a chemical substance capable of initiating polymerization upon exposure to ultraviolet radiation at wavelength(s) below 300 nm.

8. The heat sensitive record material of claim 4 wherein said photoinitiator comprises at least one substituted acetophenone.

9. The heat sensitive record material of claim 8 wherein said photoinitiator comprises at least one substituted acetophenone having one or more ultraviolet absorption peak below 330 nm.

10. The heat sensitive record material of claim 4 wherein said photoinitiator comprises 1-hydroxycyclohexyl phenyl ketone.

11. The heat sensitive record material of claim 4 wherein said ultraviolet absorber is specifically capable of absorbing ultraviolet radiation within a second wavelength range of 340–380 nm.

12. The heat sensitive record material of claim 4 wherein said ultraviolet absorber comprises at least one hydroxyphenyl compound.

13. The heat sensitive record material of claim 4 wherein said ultraviolet absorber is selected from the group consisting of:

2(2'-Hydroxy-5'-methaylphenyl)benzotriazole 2-3(3'5'-Di-t-butyl-2'-hydroxyphenyl)-5-chlorobenzotriazole 2-(3'-Butly-2'-hydroxy-5'-methanlyphenyl)-5-chlorobenzotriazole 2(2'-Hydroxy-3',6'-di-t-butylphenyl)benzotriazole 2(2'-Hydroxy-3',5'-di-t-amylphenyl)benzotriazole 2(2'-Hydroxy-5-t-octylphenyl)benzotriazole and combinations thereof.

14. The heat sensitive record material of claim 4 wherein said ultraviolet absorber comprises a combination of two active components, said active components being:

Poly(oxy-1,2-ethanediyl), α-(3-(3-(2H-benzotriazol-2-yl)-5-(1,1-dimethylethyl)-4-hydroxyphenyl)-1-oxopropyl)-ω-hydroxy; and Poly(oxy-1,2-ethanediyl), α-(3-(3-(2H-benzotriazole-2-yl)-5-(1,1-dimethylethyl)-4-hydroxyphenyl)-1-oxopropyl-ω-(3-(3-2H-benzotriazol-2-yl)-5-(1,1-dimethylethyl)-4-hydroxyphenyl)-1-oxopropoxy).

15. The heat sensitive record material of claim 4 wherein said light stabilizer comprises at least one sterically hindered amine.

16. The heat sensitive record material of claim 4 wherein said light stabilizer comprises at least one derivative of 2,2,5,5-tetra methylpiperidine having antioxidant properties.

17. The heat sensitive record material of claim 4 wherein said light stabilizer comprises, bis(1,2,2,6,6-pentamethyl-4-piperidinyl)sebacate.

18. The heat sensitive record material of claim 1 wherein the protective overcoat further comprises:

a base material containing components capable of polymerizing to form a generally solid coating upon said heat sensitive record material;

a first additive operative to initiate said polymerization of said components upon exposure to ultraviolet radiation within a first wavelength range not within said photodegradative wavelength range;

a second additive operative to prevent transmission through the polymerized overcoat of ultraviolet radiation within a second wavelength range comprising said photodegradative wavelength range.

19. The heat sensitive record material of claim 18 wherein the protective overcoat further comprises:

a third additive operative to scavenge free radicals within and adjacent said overcoat after polymerization thereof.

20. The heat sensitive record material of claim 18 wherein said first wavelength range is below 330 mn and said second wavelength range is above 330 nm.

21. The heat sensitive record material of claim 18 wherein said first additive operates as a photochemical initiator of polymerization in response to ultraviolet radiation within said first wavelength range and wherein said second additive remains substantially unaffected by the polymerization initiating exposure to said ultraviolet radiation with said first wavelength range but operative to subsequently absorb ultraviolet radiation within said second photodegradative wavelength range which is noninclusive of said first wavelength range.

* * * * *

UNITED STATES PATENT AND TRADEMARK OFFICE

CERTIFICATE OF CORRECTION

PATENT NO. : 4,886,774

DATED : December 12, 1989

INVENTOR(S) : Alfred Doi

It is certified that error appears in the above—identified patent and that said Letters Patent is hereby corrected as shown below:

Column 1, line 61, delete "cand" and substitute therefore --and--.

Column 6, line 7, delete "piperdine" and substitute therefore --piperidine--.

Column 6, line 23, delete "described" and substitute therefore --desirable--.

Column 6, line 25, delete "of" and substitute therefore --or--.

Column 8, line 43, delete "dimethyl" and substitute therefore --dimethylethyl--.

Column 9, line 15, after the words "as well as" insert --a--.

Column 10, line 36, after the word "cured" insert --by--.

Column 11, line 45, delete "2-(3'-Butly" and insert --2-(3'-1-Butly--.

Column 12, line 48, delete "operative" and substitute therefore --operates--.

Signed and Sealed this

Twenty-second Day of January, 1991

*Attest:*

HARRY F. MANBECK, JR.

*Attesting Officer*

*Commissioner of Patents and Trademarks*